US011817059B2

(12) United States Patent
Lim et al.

(10) Patent No.: US 11,817,059 B2
(45) Date of Patent: Nov. 14, 2023

(54) ELECTROLUMINESCENT DISPLAY DEVICE AND METHOD FOR SENSING ELECTRICAL CHARACTERISTICS THEREOF

(71) Applicant: LG Display Co., Ltd., Seoul (KR)

(72) Inventors: Kyung Hyun Lim, Paju-si (KR); Myung Gi Lim, Paju-si (KR); Sang Goo Jeong, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/954,290

(22) Filed: Sep. 27, 2022

(65) Prior Publication Data

US 2023/0215383 A1 Jul. 6, 2023

(30) Foreign Application Priority Data

Dec. 31, 2021 (KR) ..... 10-2021-0194524

(51) Int. Cl.
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2300/0819* (2013.01); *G09G 2300/0842* (2013.01); *G09G 2310/0286* (2013.01); *G09G 2310/0289* (2013.01); *G09G 2310/0291* (2013.01); *G09G 2310/0297* (2013.01); *G09G 2320/043* (2013.01); *G09G 2330/021* (2013.01); *G09G 2330/026* (2013.01); *G09G 2330/027* (2013.01); *G09G 2330/08* (2013.01); *G09G 2360/10* (2013.01)

(58) Field of Classification Search
CPC ..... G09G 3/3233; G09G 2300/0819; G09G 2300/0842; G09G 2310/0286; G09G 2310/0289; G09G 2310/0291; G09G 2310/0297; G09G 2320/043; G09G 2330/021; G09G 2330/026; G09G 2330/027; G09G 2330/08; G09G 2360/10; G09G 3/30–3291
See application file for complete search history.

(56) References Cited

U.S. PATENT DOCUMENTS

2014/0022289 A1* 1/2014 Lee ..... G09G 3/006 345/76
2016/0351096 A1* 12/2016 Tani ..... G09G 3/3233
2017/0352305 A1* 12/2017 Chang ..... G09G 3/2085
2019/0088208 A1* 3/2019 Chang ..... G09G 3/3233

FOREIGN PATENT DOCUMENTS

KR 10-2015-0103432 A 9/2015
KR 10-2019-0059674 A 5/2019

* cited by examiner

*Primary Examiner* — Roberto W Flores
(74) *Attorney, Agent, or Firm* — Morgan, Lewis & Bockius LLP

(57) ABSTRACT

The present disclosure relates to an electroluminescent display device and a method for sensing electrical characteristics thereof, and the electroluminescent display device includes a display panel including a plurality of pixels including a sensing pixel and a non-sensing pixel connected to each data line, the plurality of pixels sharing one sensing line, a sensing circuit configured to sense an electrical characteristic value of the sensing pixel based on a sensing voltage applied to the shared sensing line, and a feedback unit configured to apply a feedback voltage according to the sensing voltage applied to the shared sensing line to the data line of the non-sensing pixel.

15 Claims, 14 Drawing Sheets

ELECTROLUMINESCENT DISPLAY DEVICE AND METHOD FOR SENSING ELECTRICAL CHARACTERISTICS THEREOF

This application claims the benefit of Korean Patent Application No. 10-2021-0194524, filed on Dec. 31, 2021, which is hereby incorporated by reference as if fully set forth herein.

BACKGROUND

Technical Field

The present disclosure relates to an electroluminescent display device and a method for sensing electrical characteristics thereof.

Discussion of the Related Art

An electroluminescent display device including organic light emitting diodes (referred to hereinafter as OLEDs) has sub-pixels each including an OLED arranged in a matrix form and adjusts the luminance of the sub-pixels according to the grayscale of image data to display an image. The sub-pixels include light emitting elements and driving thin film transistors (TFTs) that control a driving current input to the light emitting elements.

Sub-pixels of an organic light emitting display have a deterioration characteristic in which a threshold voltage changes as driving time elapses. When the threshold voltage has changed, there is a problem in that image quality is deteriorated due to a deviation in current flowing through organic light emitting diodes (OLEDs) even when the same data voltage Vdata is applied. In order to solve this problem, various methods for compensating for deterioration of an organic light emitting display are being studied.

A method for sensing deterioration may vary according to a sub-pixel structure. Accordingly, there is a need for a method capable of effectively sensing and compensating for deterioration characteristics according to a sub-pixel structure.

SUMMARY

Accordingly, embodiments of the present disclosure are directed to an electroluminescent display device and a method for sensing electrical characteristics thereof that substantially obviate one or more of the problems due to limitations and disadvantages of the related art.

An aspect of the present disclosure is to provide an organic light emitting display device capable of preventing decrease in sensing accuracy of a sensing pixel due to parasitic capacitance of a non-sensing pixel when a plurality of pixels shares one sensing line and a method for sensing electrical characteristics thereof.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described herein, an electroluminescent display device comprises a display panel including a plurality of pixels including a sensing pixel and a non-sensing pixel connected to each data line, the plurality of pixels sharing one sensing line, a sensing circuit configured to sense an electrical characteristic value of the sensing pixel based on a sensing voltage applied to the shared sensing line, and a feedback unit configured to apply a feedback voltage according to the sensing voltage applied to the shared sensing line to the data line of the non-sensing pixel.

The feedback voltage may have a voltage value that minimizes a potential difference between the shared sensing line and the data line of the non-sensing pixel.

The electroluminescent display device may further include a data driver configured to supply a data voltage for sensing to the data line of the sensing pixel.

The feedback unit may include an amplifier configured to receive the sensing voltage, to apply a preset gain to the sensing voltage, and to output the sensing voltage, and a feedback switch configured to connect an output line of the amplifier to the data line of the non-sensing pixel.

The amplifier may include a non-inverting amplifier including a non-inverting input terminal to which the shared sensing line is connected, and an inverting input terminal to which a feedback line of an output terminal is connected, the output terminal being connected to the data line of the non-sensing pixel, a first resistor connected to the inverting input terminal, and a second resistor connected to the feedback line.

The first resistor and the second resistor may include variable resistors.

The electroluminescent display device may further include a defective pixel determination unit configured to compare the sensing voltage with a preset reference voltage and to control the feedback voltage not to be applied to the data line of the non-sensing pixel if the sensing voltage is equal to or greater than the reference voltage.

The defective pixel determination unit may include a non-inverting input terminal to which the shared sensing line is connected, an inverting input terminal to which the reference voltage is input, and a comparator configured to output a result of comparison between the sensing voltage and the reference voltage.

The electroluminescent display device may further include a selector configured to apply the feedback voltage or a data voltage output from the data driver to the data line according to a determination result of the defective pixel determination unit.

The selector may include a multiplexer configured to output the feedback voltage to the data line of the non-sensing pixel if the sensing voltage is less than the reference voltage and to apply the data voltage output from the data driver to the data line if the sensing voltage is greater than the reference voltage.

The electrical characteristic value of the sensing pixel may include a threshold voltage value of a driving TFT of the sensing pixel.

In another aspect, a method for sensing electrical characteristics of an electroluminescent display device including a display panel having a plurality of pixels including a sensing pixel and a non-sensing pixel connected to each data line, the plurality of pixels sharing one sensing line comprises supplying a data voltage for sensing to the data line of the sensing pixel, applying a feedback voltage to the data line of the non-sensing pixel according to a sensing voltage applied to the shared sensing line, and sensing an electrical characteristic value of the sensing pixel based on the sensing voltage.

The feedback voltage may have a voltage value that minimizes a potential difference between the shared sensing line and the data line of the non-sensing pixel.

The method may further include comparing the sensing voltage with a preset reference voltage, wherein the applying of the feedback voltage to the data line of the non-sensing pixel according to the sensing voltage applied to the shared sensing line comprises applying the feedback voltage to the data line of the non-sensing pixel if the sensing voltage is less than the reference voltage.

The method may further include applying a data voltage output from a data driver to the data line if the sensing voltage is equal to or greater than the reference voltage.

When a plurality of pixels shares a single sensing line in the electroluminescent display device according to an embodiment of the present disclosure, a voltage having the same potential as the sensing line can be applied to a data line of a non-sensing pixel such that a potential difference between the sensing line and the data line of the non-sensing pixel is canceled, thereby preventing decrease in sensing accuracy of a sensing pixel due to parasitic capacitance.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain various principles.

DETAILED DESCRIPTION

Figure 1:
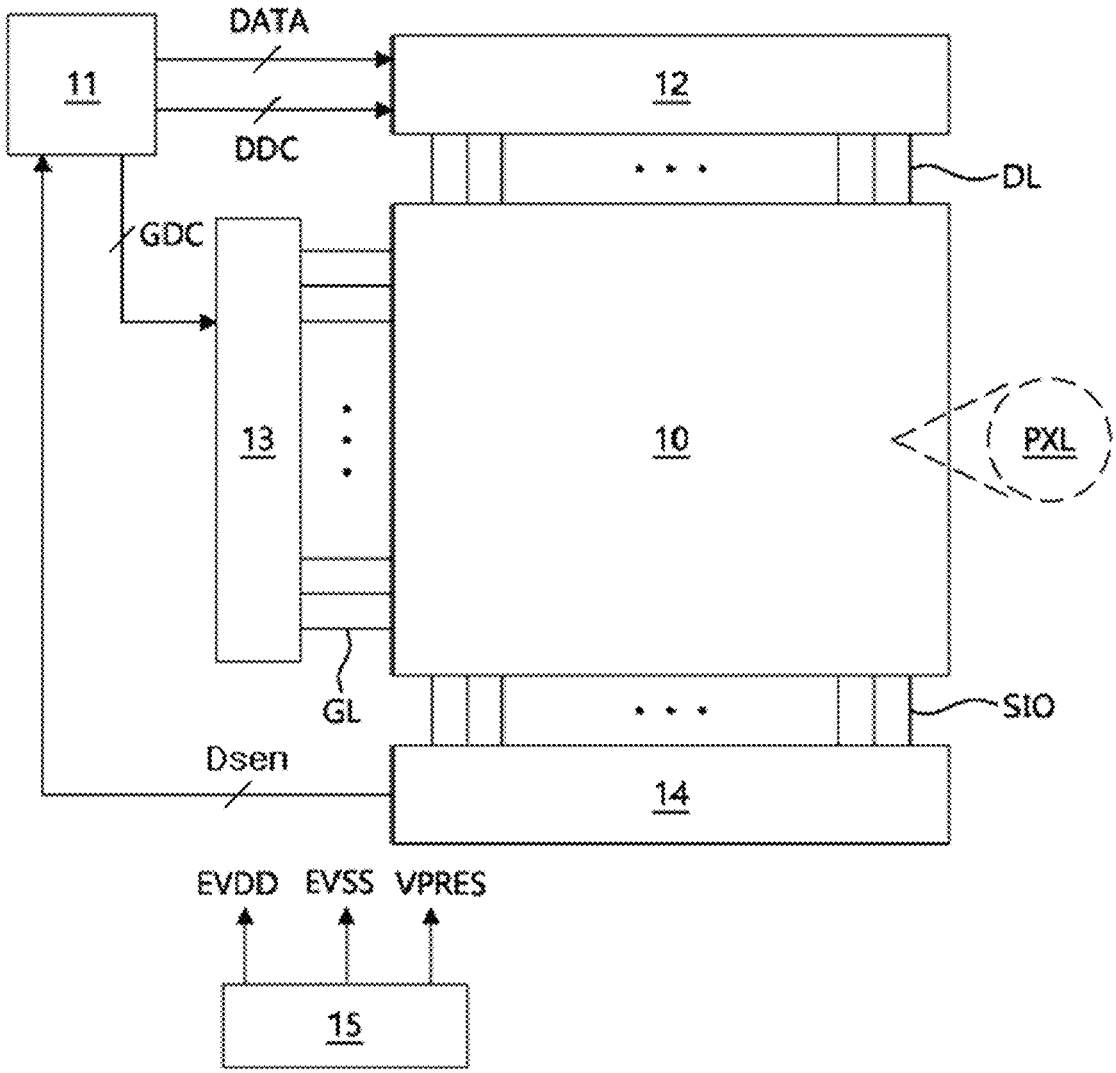
FIG. 1 is a schematic block diagram of an electroluminescent display device according to an embodiment of the present disclosure.

The advantages and features of the present disclosure and the way of attaining them will become apparent with reference to embodiments described below in detail in conjunction with the accompanying drawings. The present disclosure, however, is not limited to the embodiments disclosed hereinafter and may be embodied in many different forms. Rather, these exemplary embodiments are provided so that this disclosure will be thorough and complete and will fully convey the scope to those skilled in the art. Thus, the scope of the present disclosure should be defined by the claims.

The shapes, sizes, ratios, angles, numbers, and the like, which are illustrated in the drawings in order to describe various embodiments of the present disclosure, are merely given by way of example, and therefore, the present disclosure is not limited to the illustrations in the drawings. The same or extremely similar elements are designated by the same reference numerals throughout the specification. In the present specification, when the terms "comprise", "include", and the like are used, other elements may be added unless the term "only" is used. An element described in the singular form is intended to include a plurality of elements unless the context clearly indicates otherwise.

In the interpretation of constituent elements included in the various embodiments of the present disclosure, the constituent elements are interpreted as including an error range even if there is no explicit description thereof.

In the description of the various embodiments of the present disclosure, when describing positional relationships, for example, when the positional relationship between two parts is described using "on", "above", "below", "aside", or the like, one or more other parts may be located between the two parts unless the term "directly" or "closely" is used.

In the description of the various embodiments of the present disclosure, although terms such as, for example, "first" and "second" may be used to describe various elements, these terms are merely used to distinguish the same or similar elements from each other. Therefore, in the present specification, an element modified by "first" may be the same as an element modified by "second" within the technical scope of the present disclosure unless otherwise mentioned.

The same reference numbers will be used throughout this specification to refer to the same or like parts.

Hereinafter, embodiments of the present disclosure will be described in detail with reference to the attached drawings. In the following description of the present disclosure, a detailed description of known functions and configurations incorporated herein will be omitted when it may obscure the subject matter of the present disclosure.

FIG. 1 is a schematic block diagram of an electroluminescent display device according to an embodiment of the present disclosure.

Referring to FIG. 1, the electroluminescent display device according to an embodiment of the present disclosure may include a display panel 10, a timing controller 11, a data driver 12, a gate driver 13, a sensing circuit 14, and a power supply circuit 15.

In an area of a screen on which an input image is displayed in the display panel 10, data lines DL extending in a column direction (or vertical direction) and gate lines GL extending in a row direction (or horizontal direction) intersect and unit pixels PXL are disposed in a matrix form at intersections to form a pixel array. Each data line DL is commonly connected to unit pixels adjacent in the column direction, and each gate line GL is commonly connected to unit pixels PXL adjacent in the row direction.

Each unit pixel PXL includes a plurality of sub-pixels. A plurality of sub-pixels may constitute one unit pixel PXL to create various color combinations. To simplify the pixel array, sub-pixels constituting the same unit pixel PXL may share the same sensing line SIO.

When sub-pixels are deteriorated with the lapse of driving time, electrical characteristics such as a threshold voltage and electron mobility of each sub-pixel change. Since these changes in electrical characteristics cause change in luminance, it is necessary to sense and compensate for electrical characteristics of each sub-pixel. Sensing lines SIO are used to sense characteristics of a sub-pixel. In the pixel array, the sensing lines SIO may be disposed in the column direction parallel to the data lines DL without being limited thereto.

The timing controller 11 receives timing signals such as a vertical synchronization signal Vsync, a horizontal synchronization signal Hsync, a data enable signal DE, and a dot clock signal DCLK from a host system and generates timing control signals for controlling operation timing of the data driver 12 and the gate driver 13. The timing control signals may include a gate timing control signal GDC for controlling the operation of the gate driver 13 and a data timing control signal DDC for controlling the operation of the data driver 12.

The timing controller 11 receives image data DATA from the host system and receives sensed data Dsen including electrical characteristics of each sub-pixel from the sensing circuit 14. The timing controller 11 may correct the image data DATA according to the sensed data Dsen and supply the same to the data driver 12.

The timing controller 11 may temporally separate a display operation from a sensing operation based on the timing control signals DDC and GDC. The display operation serves to display image data DATA on the screen. The sensing operation serves to sense electrical characteristics of a pixel PXL.

The display operation may be performed in a vertical active period in which transition of the data enable signal between a logic high level and a logic low level Occurs in one frame, and the sensing operation may be performed in a vertical blank period excluding the vertical active period in one frame. In the vertical blank period, the data enable signal continuously maintains a logic low level. Meanwhile, the sensing operation may be performed in a power-on period from when the system main power is applied to when image reproduction is started or in a power-off period from when image reproduction ends to when the system main power is released. Further, the sensing operation may be performed in a state in which only the screen of the display device is turned off while the system power is applied, for example, in a standby mode, a sleep mode, a low power mode, and the like. The timing controller 11 may control general operations for the sensing operation when sensing operation conditions are satisfied according to a predetermined sensing process.

The data driver 12 is connected to the sub-pixels through data lines DL. The data driver 12 generates a data voltage required for the display operation or the sensing operation of the sub-pixels according to the data timing control signal DDC and supplies the data voltage to the data lines DL. The data voltage for the display operation is a digital-to-analog conversion result with respect to the image data DATA, and for this, the data driver 12 may include a plurality of digital-to-analog converters (hereinafter referred to as DACs).

The gate driver 13 is connected to the sub-pixels through gate lines GL. The gate driver 13 generates scan signals based on the gate timing control signal GDC and supplies the scan signals to the gate lines 15 in accordance with data voltage supply timing. A horizontal display line to which a data voltage is to be supplied is selected by a scan signal.

The gate driver 13 generates scan signals for the display operation and supplies the scan signals to the gate lines 15 in accordance with supply timing of a data voltage for display. The gate driver 13 may generate a scan signal for the sensing operation and supply the scan signal to the gate lines 15 in accordance with supply timing of a data voltage for detection.

The gate driver 13 may include a plurality of gate drive integrated circuits each including a gate shift register, a level shifter for converting an output signal of the gate shift register into swing widths of a scan-on voltage and a scan-off voltage, and an output buffer. Alternatively, the gate driver 13 may be directly formed on the substrate of the display panel 10 in a gate driver-in-panel (GIP) structure. In the case of the GIP structure, the level shifter may be mounted on a control printed circuit board and the gate shift register may be formed in a bezel area that is a non-display area of the display panel 10. The gate shift register includes a plurality of scan output stages (hereinafter, GIP elements) connected in a cascade manner. The GIP elements are independently connected to the gate lines GL to output scan signals to the gate lines GL.

The sensing circuit 14 is connected to the unit pixels PXL of the display panel 10 through read-out lines SIO. The sensing circuit 14 detects the voltage of a read-out line SIO that is changed by the current flowing through the sub-pixels during the sensing operation and converts the detected voltage value into a digital signal to generate sensed data Dsen. Then, the sensing circuit 14 transmits the sensed data Dsen to the timing controller 11.

The power supply circuit 15 generates a high-level driving voltage EVDD and a low-level driving voltage EVSS necessary for the display operation and the sensing operation of the sub-pixels. The power supply circuit 15 generates an initialization voltage necessary for the sensing operation of the sub-pixels. The power supply circuit 15 may generate a base voltage VPRES for initializing the sensing lines SIO during the sensing operation.

Figure 2:
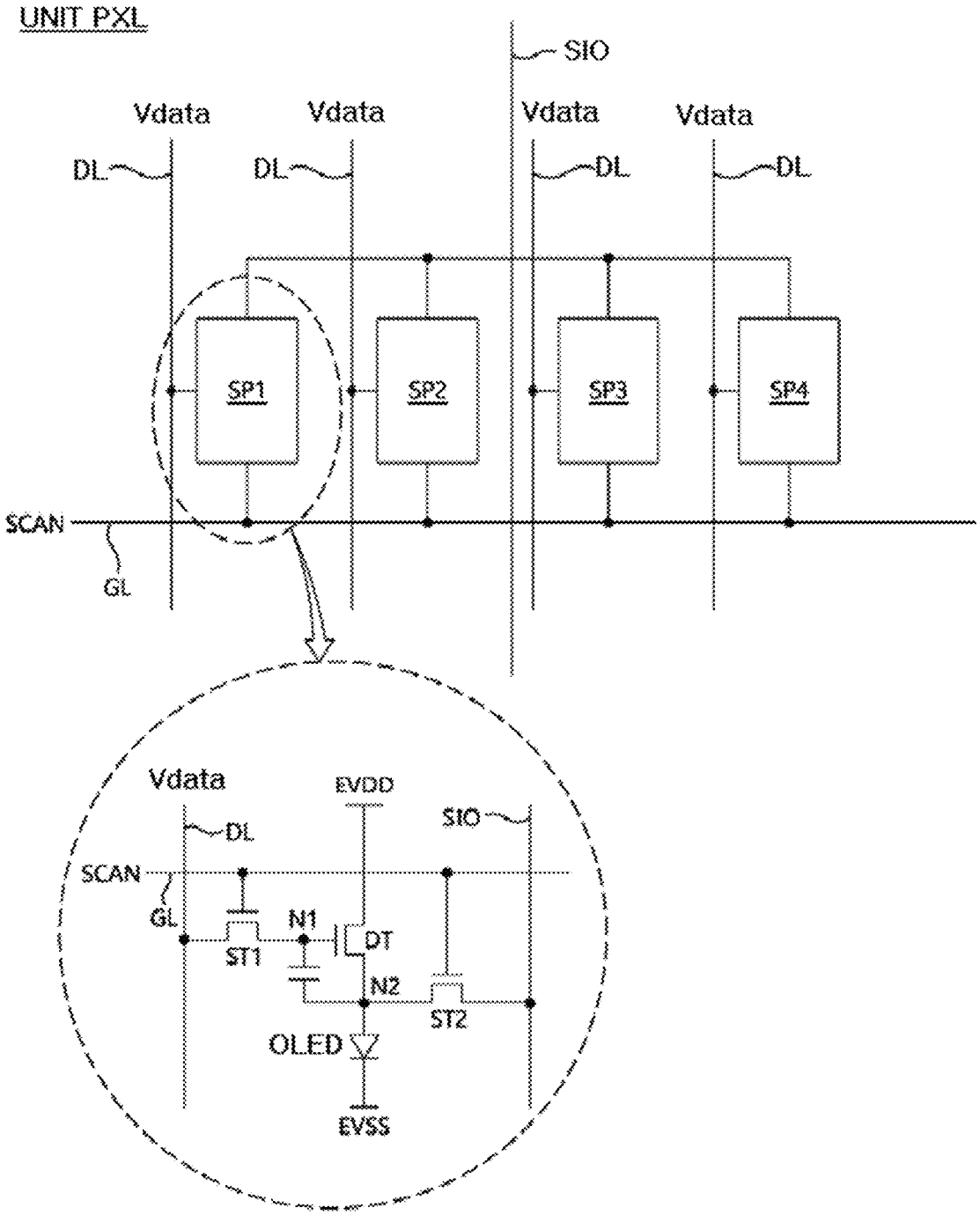
FIG. 2 is an exemplary diagram of a unit pixel circuit formed in a display panel of FIG. 1.

FIG. 2 is a diagram illustrating a connection configuration of a unit pixel UNIT PXL according to an embodiment of the present specification.

Referring to FIG. 2, the unit pixel UNIT PXL may include four sub-pixels SP1, SP2, SP3, and SP4 sharing a read-out line SIO. The four sub-pixels SP1, SP2, SP3, and SP4 may be R (red), G (green), B (blue), and W (white) sub-pixels. Each of the sub-pixels SP1, SP2, SP3, and SP4 may include, for example, an organic light emitting device OLED, a driving element DT, switch elements ST1 and ST2, and a storage capacitor Cst.

The OLED emits light according to a driving current supplied from the driving element DT. The OLED emits light only during the display operation and does not emit light during the sensing operation. The anode of the OLED is connected to a second node N2 and the cathode thereof is connected to an input terminal of the low-level driving voltage EVSS.

The driving element DT generates a driving current for display according to a gate-source voltage, that is, a difference voltage between a data voltage Vdata supplied to the data lines DL and a reference voltage and supplies the same to the OLED. A gate electrode of the driving element DT is connected to a first node N1, a drain electrode thereof is connected to an input terminal of the high-level driving voltage EVDD, and a source electrode thereof is connected to the second node N2.

The first switch element ST1 is connected between a data line DL and the first node N1 and is turned on according to a scan signal SCAN from a gate line GL. When the first switch element ST1 is turned on during the sensing operation, the data voltage Vdata for sensing is applied to the first node N1. A gate electrode of the first switch element ST1 is connected to the gate line GL, a source electrode thereof is connected to the data line DL, and a drain electrode thereof is connected to the first node N1.

The second switch element ST2 is connected between the read-out line SIO and the second node N2 and is turned on according to the scan signal SCAN from the gate line GL. The second switch element ST2 is turned on in an initialization period during the sensing operation, applies the base voltage charged in the read-out line SIO to the second node N2, and maintains an on state in a detection period following the initialization period to change the voltage of the read-out line SIO by the voltage of the second node N2. A gate electrode of the second switch element ST2 is connected to the gate line GL, a drain electrode thereof is connected to the second node N2, and a source electrode thereof is connected to the read-out line SIO.

The storage capacitor Cst is connected between the first node N1 and the second node N2 and stores the gate-source voltage of the driving element DT.

FIG. 2 is a simplified and equivalent diagram of the circuit configuration of each sub-pixel SP. In reality, a driving circuit for driving the organic light emitting diode OLED in each sub-pixel SP may include one or more transistors in addition to the driving transistor DT and the storage capacitor Cst, and in some cases, may further include one or more capacitors.

Meanwhile, the driving transistor DT in each sub-pixel SP may be deteriorated as driving time elapses, and thus electrical characteristics, such as a threshold voltage Vth thereof, may change. Accordingly, the electroluminescent display device according to the present embodiment can provide a compensation function for sensing electrical characteristics of the sub-pixels SP and compensating for a luminance deviation according to the sensed electrical characteristics.

Figure 3:
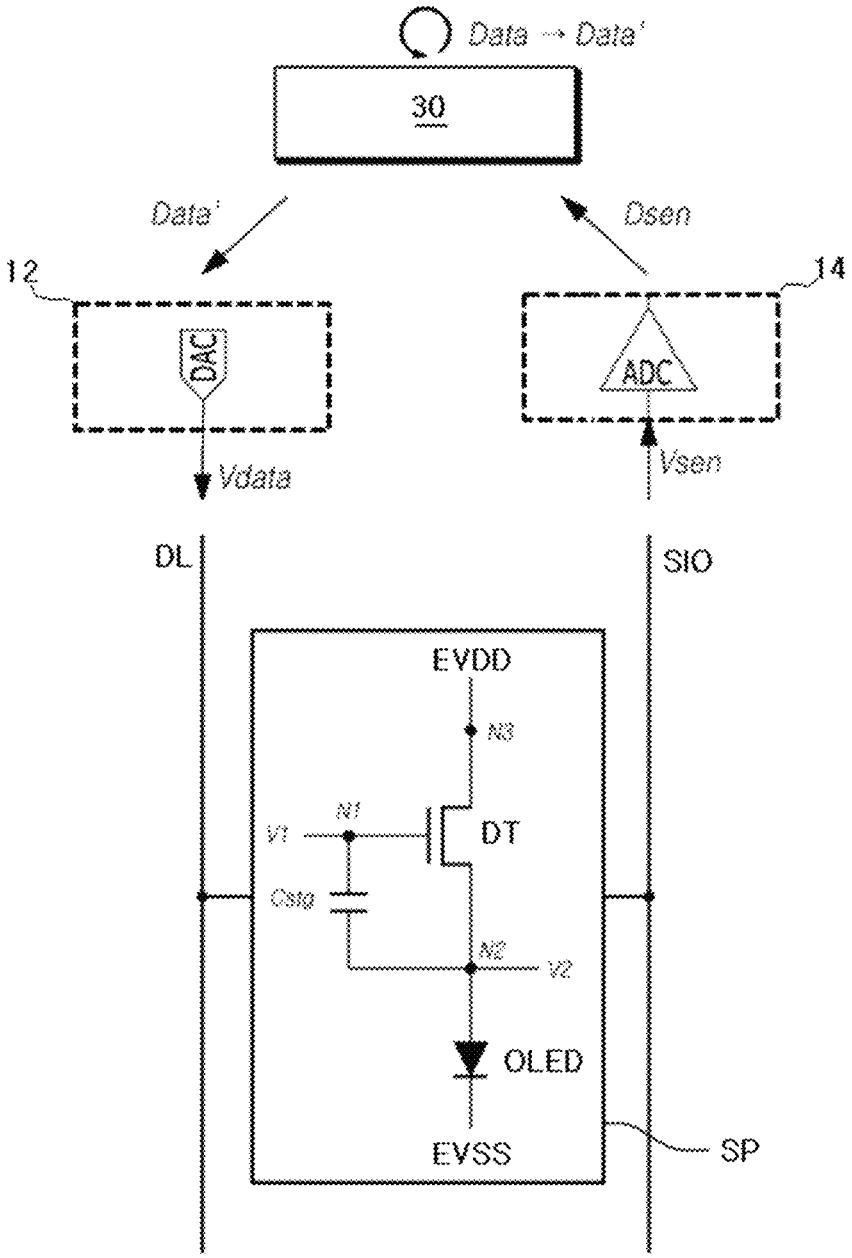
FIG. 3 is a block diagram schematically illustrating a compensation configuration of the electroluminescent display device according to an embodiment of the present disclosure.

FIG. 3 shows a compensation configuration of the electroluminescent display device according to an embodiment of the present disclosure.

Referring to FIG. 3, the configuration for compensation in the electroluminescent display device includes the data driver 12, the sensing circuit 14, and a compensator 30.

The data driver 12 generates a data voltage Vdata required for the sensing operation and supplies the same to the data lines DL. To this end, the data driver 12 may include a plurality of DACs.

The sensing circuit 14 is connected to the unit pixels PXL of the display panel 10 through the read-out line SIO. The sensing circuit 14 detects the voltage of the sensing line SIO that is changed by the current flowing through the sub-pixels SP during the sensing operation and converts the detected voltage value into a digital signal to generate sensed data Dsen. To this end, the sensing circuit 14 may include an analog-to-digital converter (referred to hereinafter as an ADC) and a sampling switch SAM. The sampling switch SAM is turned on during a sampling period to connect the read-out line (SIO) and the ADC. The ADC may be electrically connected to a sensing node of each sub-pixel SP through the read-out line SIO. The ADC converts a sensed voltage Vsen input through the read-out line SIO into a digital value to generate sensed data Dsen.

The compensator 30 may determine a data compensation amount for each sub-pixel SP based on the received sensed data Dsen. The compensator 30 may output compensated data Data' by reflecting the data compensation amount in data to be supplied to the sub-pixel SP. The compensator 30 may be included in the timing controller 11.

Figure 4:
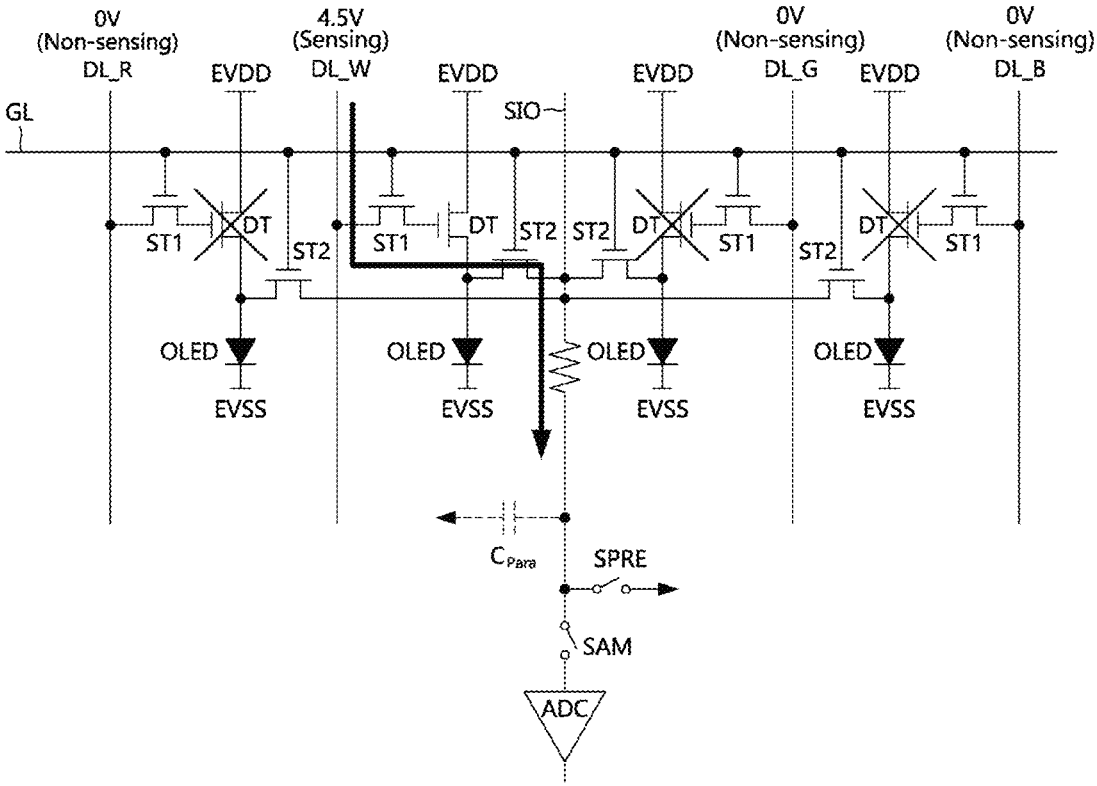
FIG. 4 is a diagram illustrating an operation of a sub-pixel during a sensing operation of an electroluminescent display device according to a comparative example.
Figure 5:
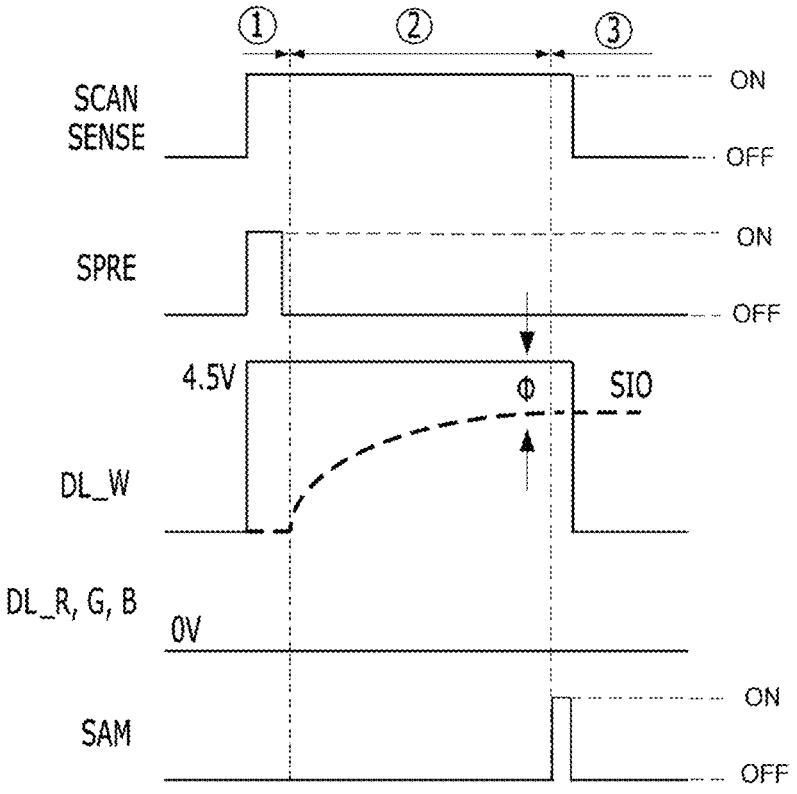
FIG. 5 is a diagram illustrating control signal waveforms and a potential change waveform for each period during the sensing operation of FIG. 4.
Figure 6:
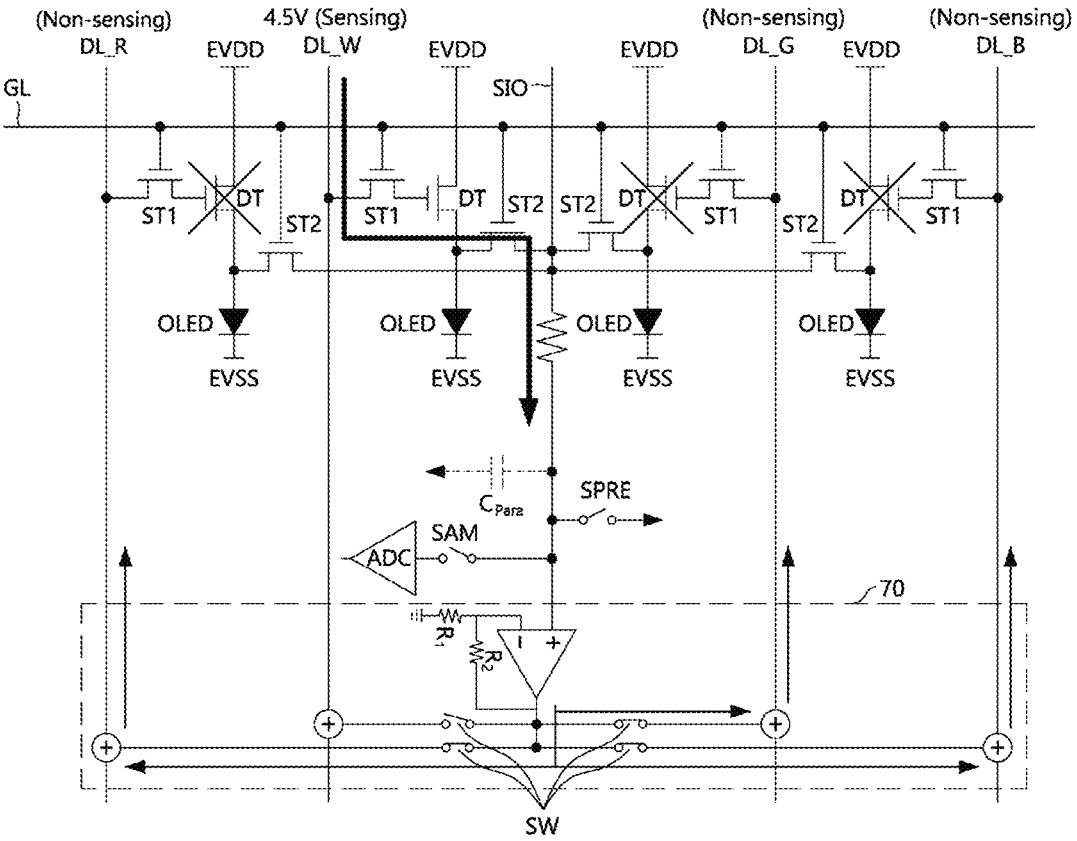
FIG. 6 is a diagram illustrating an operation of a sub-pixel during a sensing operation of an electroluminescent display device according to an embodiment.
Figure 7:
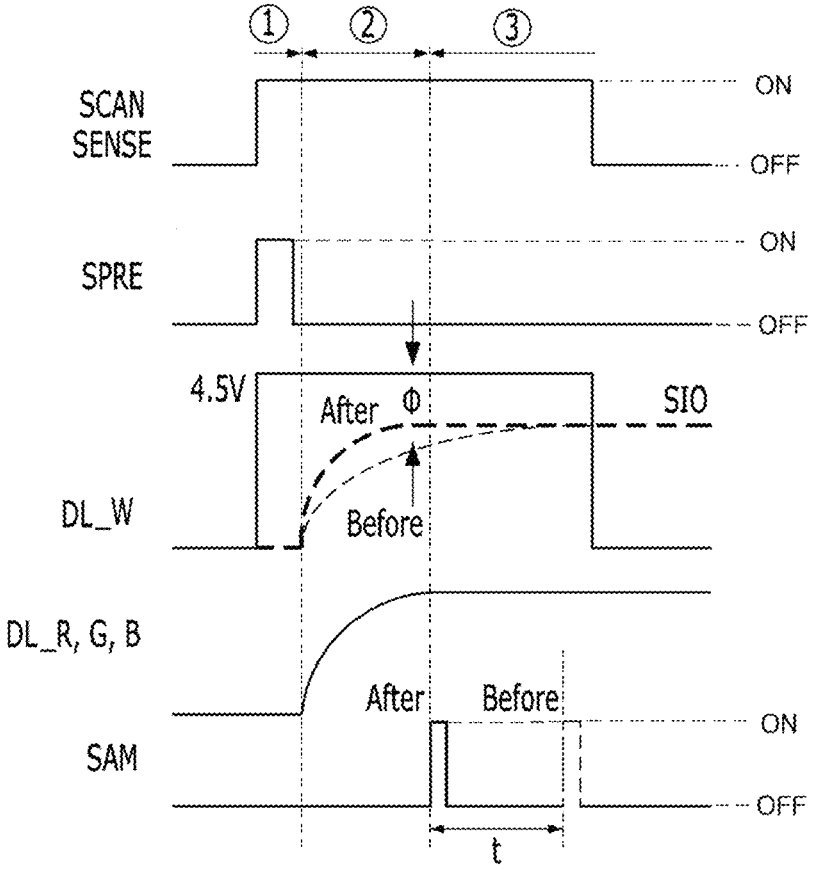
FIG. 7 is a diagram illustrating control signal waveforms and a potential change waveform for each period during the sensing operation of FIG. 6.

FIGS. 4 and 5 are diagrams for describing a method for sensing electrical characteristics of an electroluminescent display device according to a comparative example, and FIGS. 6 and 7 are diagrams for describing a method for sensing electrical characteristics of the electroluminescent display device according to an embodiment.

In both the comparative example and the embodiment, a display panel in which one unit pixel corresponds to one read-out line SIO is targeted. The unit pixel UNIT PXL may include four sub-pixels sharing the read-out line SIO. The four sub-pixels may be R (red), W (white), G (green), and B (blue) sub-pixels. The four sub-pixels share one read-out line SIO and one gate line GL. The four sub-pixels are connected to an R data line DL_R to which R data is supplied, a W data line DL_W to which W data is supplied, a G data line DL_G to which G data is supplied, and a B data line DL_B to which B data is supplied. Accordingly, the four sub-pixels independently receive data through the data lines DL_R, DL_W, DL_G, and DL_B, and electrical characteristics thereof are independently sensed for each color during the sensing operation. When a pixel of one color among the four sub-pixels becomes a sensing target, pixels of the other colors become non-sensing targets. A pixel to be sensed is a sensing pixel, and a pixel not to be sensed is a non-sensing pixel. Hereinafter, as an example, it is assumed that the W sub-pixel is a sensing pixel and the remaining pixels (R, G, and B pixels) are non-sensing pixels.

FIGS. 4 and 5 are diagrams for describing a method for sensing electrical characteristics of the electroluminescent display device according to the comparative example. According to the comparative example, the data driver 12 applies a sensing voltage (e.g., 4.5 V) to the W data line DL_W to which the W subpixel, which is a sensing pixel, among the sub-pixels sharing the read-out line SIO, is connected, and a voltage (e.g., 0 V) which can maintain driving TFTs of the non-sensing pixels in an off state is applied to the data lines DL_R, DL_G, and DL_B to which the non-sensing pixels are connected.

Referring to FIGS. 4 and 5, the sensing method according to the comparative example may include an initialization period ①, a sensing period ②, and a sampling period ③.

In the initialization period ①, when a scan control signal SCAN/SENSE at an ON level is applied to the gate line GL, first switch TFTs ST1 and second switch TFTs ST2 of the four sub-pixels are all turned on.

In the initialization period ①, when an on-level signal is applied to an initialization switch SPRE, the initialization switch SPRE is turned on and an initialization voltage Vpre is supplied to the read-out line SIO. The sampling switch SAM is turned off by an off-level signal, and thus connection between the read-out line SIO and the ADC of the sensing circuit 14 is canceled. The initialization voltage Vpre supplied to the read-out line SIO is applied to the source electrodes of the driving TFTs DT included in the sub-pixels. Unlike the sensing pixel, in the non-sensing pixels, the driving TFTs DT must not be turned on. To this end, it is desirable that a difference between a voltage applied to the non-sensing pixels and the initialization voltage Vpre be set to a value lower than the threshold voltage of the driving TFTs DT. In addition, since the initialization voltage Vpre is commonly applied to the sub-pixels within the unit pixel, it is desirable to set the initialization voltage Vpre to a value lower than the threshold voltage (operating point voltage) of the light emitting element OLED to prevent the non-sensing pixels from being unnecessarily turned on.

A voltage of 4.5 V is applied to the data line DL_W of the sensing pixel and a voltage of 0 V is applied to the data lines DL_R, DL_G, and DL_B of the non-sensing pixels in the initialization period ①. Accordingly, the driving TFT DT included in the sensing pixel W is programmed such that the pixel current can flow, and driving TFTs DT included in the non-sensing pixels R, G, and B are programmed such that the pixel current cannot flow during the initialization period ①.

Within the sensing period ②, the initialization switch SPRE is turned off and thus the voltage of the read-out line SIO can increase.

During the sensing period ②, a current Ids flows through the driving TFT DT of the sensing pixel W, and thus the voltage of the source node gradually increases. The voltage of the source node is boosted to the voltage of the gate electrode of the driving TFT DT until a difference between the voltage of the gate node and the voltage of the source node corresponds to the threshold voltage Vth of the driving TFT DT. As described above, boosting of the voltage of the source node of the driving TFT DT to the voltage of the gate electrode of the driving TFT DT is referred to as "source following". When the voltage difference between the gate node and the source node reaches the threshold voltage Vth, the current Ids flowing through the driving TFT DT becomes zero and the potential of the source node is saturated. In this manner, when the driving TFT DT of the sensing pixel W is operated in a source following manner during the sensing period ②, the source voltage of the driving TFT DT is stored in a line capacitor $C_{para}$ of the read-out line SIO.

Within the sampling period ③, the sampling switch SAM is turned on by the on-level signal to connect the read-out line (SIO) and the ADC. Accordingly, the source voltage value of the driving TFT DT stored in the read-out line SIO can be sampled. Thereafter, a difference (4.5 V−Sen=Φ) between the voltage value (4.5 V) applied to the sensing pixel and a voltage sensed from the read-out line SIO can be calculated to obtain the threshold voltage Vth of the driving TFT DT of the sensing pixel.

As described above, in the sensing method according to the comparative example, 0 V is applied to the non-sensing pixels and the data voltage (4.5 V) for sensing is applied to the sensing pixel, and the source voltage of the driving TFT DT stored in the line capacitor $C_{para}$ of the read-out line SIO is sampled through the source following operation.

However, since the data voltage is applied to the data line DL_W of the sensing pixel and 0 V is applied to the data lines DL_R, DL_G, and DL_B of the non-sensing pixels in the sensing method according to the comparative example, line capacitance $C_{para}$ of the read-out line SIO arranged along with the data lines DL increases. That is, due to the potential difference between the data lines DL_R, DL_G, and DL_B of the non-sensing pixels having a potential of 0 V and the read-out line SIO in which the sensing voltage is stored, the line capacitance of the read-out line SIO increases, resulting in increase in sensing time.

In order to improve this phenomenon, in the embodiment of the present disclosure, the potential difference between the data lines DL of non-sensing pixels and the read-out line SIO is removed, thereby eliminating capacitance generated between the data lines DL and the read-out line SIO. Accordingly, the capacitance of the read-out line SIO is reduced and thus the time during which the source voltage of the sensing pixel is charged in the read-out line SIO can be reduced, resulting in decrease in the sensing time.

FIGS. 6 and 7 are diagrams for describing a method for sensing electrical characteristics of an electroluminescent display device according to an embodiment. FIG. 6 is a diagram showing a schematic pixel structure of an electroluminescent display device according to an embodiment and an operation of a sub-pixel during the sensing operation, and FIG. 7 illustrates control signal waveforms and a potential change waveform for each period during the sensing operation of FIG. 6.

Referring to FIG. 6, the electroluminescent display device according to the embodiment may additionally include a feedback unit 70 that feeds back the voltage of a read-out line SIO to the data line of a non-sensing pixel in a pixel structure in which four sub-pixels share one read-out line SIO.

The four sub-pixels share one read-out line SIO and one gate line GL. The four sub-pixels are connected to an R data line DL_R to which R (red) data is supplied, a W data line DL_W to which W (white) data is supplied, and a G data line DL_G to which G (green) data is supplied, and a B data line DL_B to which B (blue) data is supplied.

The feedback unit 70 feeds back a voltage having the same potential as the voltage of the read-out line SIO to the data lines DL_R, DL_G, and DL_B of the non-sensing pixels such that a potential difference is not generated between the read-out line SIO and the data lines DL_R, DL_G, and DL_B. The feedback unit 70 may include an amplifier Amp that receives the sensing voltage of the read-out line SIO, applies a preset gain thereto, and outputs the sensing voltage to which the gain has been applied, and a feedback switch SW that connects the output terminal of the amplifier to the data line of a non-sensing pixel.

As the amplifier Amp, a non-inverting amplifier in which the voltage of the read-out line SIO is input to a non-inverting terminal (+) and an output voltage is fed back to an inverting terminal (−) may be applied. In the non-inverting amplifier, the input voltage and the output voltage have the same polarity, and a gain can be adjusted according to the ratio of an input resistor R1 to a feedback resistor R2 interposed in a feedback line of the output voltage. The output voltage Vout of such an amplifier can be represented as follows.

<Output Voltage of Amplifier>

$$V_{out} = \left(1 + \frac{R_2}{R_1}\right)V_{in}$$

As described above, the gain value (1+R2/R1) is determined by the ratio of the sizes of the resistors R1 and R2. If the resistors R1 and R2 that determine the gain are designed as variable resistors that can be adjusted with digital values, a desired correct gain value can be obtained. The gain of the amplifier may be set such that the voltage of the read-out line SIO and the voltage fed back to the data lines DL of the non-sensing pixels have the same potential as long as possible, and the gain may be set such that it is output within a range within which the non-sensing pixels are not turned on by the voltage fed back to the data lines.

The feedback switch SW is interposed in a connection line connecting the data line DL of each sub-pixel and the output terminal of the amplifier. The feedback switch SW may be connected to each of the four data lines DL_R, DL_W, DL_G, and DL_B. When the switch SW is turned on, the corresponding data line DL and the output terminal of the amplifier are connected, and when the switch SW is turned off, the connection between the corresponding data line DL and the output terminal of the amplifier is canceled. The feedback switch SW operates such that the output terminal of the amplifier is connected to the data line of a non-sensing pixel. The on/off operation of the feedback switch SW may be controlled by the timing controller 11 that controls the sensing operation but is not limited thereto.

The aforementioned configuration of the feedback unit 70 is merely an embodiment, and various circuit configurations capable of feeding back a voltage having the same potential as the voltage of the read-out line SIO to the data line DL of a non-sensing pixel may be applied.

When electrical characteristics of the W subpixel are sensed in the electroluminescent display device according to the embodiment having the above configuration, a sensing voltage (e.g., 4.5 V) is applied to the W data line DL_W, and a voltage having the same potential as that of the read-out line SIO is applied to the data lines DL_R, DL_G, and DL_B of the non-sensing pixels.

Referring to FIG. 7, the sensing method according to the embodiment may include an initialization period ①, a sensing period ②, and a sampling period ③.

In the initialization period ①, when the scan control signal SCAN/SENSE at an ON level is applied to the gate line GL, first switch TFTs ST1 and second switch TFTs ST2 of the four sub-pixels are all turned on.

During the initialization period ①, when an on-level signal is applied to an initialization switch SPRE, the initialization switch SPRE is turned on and an initialization voltage Vpre is supplied to the read-out line SIO. A sampling switch SAM is turned off by an off-level signal, and thus connection between the read-out line SIO and the ADC of the sensing circuit 14 is canceled. The initialization voltage Vpre supplied to the read-out line SIO is applied to the source electrodes of the driving TFTs DT included in the sub-pixels.

In the initialization period ①, a sensing voltage (e.g., 4.5 V) is applied to the W data line DL_W to which the W sub-pixel, which is a sensing pixel, is connected. Accordingly, during the initialization period ①, the driving TFT DT included in the sensing pixel W is programmed such that the pixel current can flow.

In the sensing period ②, the initialization switch SPRE is turned off and thus the voltage of the read-out line SIO can increase. Accordingly, the voltage of the read-out line SIO can be input to the non-inverting terminal (+) of the amplifier included in the feedback unit 70. Feedback switches SW connected to the data lines DL_R, DL_W, DL_G, and DL_B of the non-sensing pixels are turned on such that the data lines DL_R, DL_W, DL_G, and DL_B are connected to the read-out line SIO. A switch connected to the W data line DL_W to which the W subpixel, which is a sensing pixel, is connected is maintained in an off state.

During the sensing period ②, the driving TFT DT of the sensing pixel W performs a source-following operation to increase the voltages of the source node and the read-out line SIO connected to the source node.

The voltage of the read-out line SIO is input to the non-inverting terminal (+) of the amplifier of the feedback unit 70. The amplifier receives the voltage of the read-out line SIO and outputs a voltage having the same potential as the voltage of the read-out line SIO to the data lines DL_R, DL_G, and DL_B of the non-sensing pixels. Accordingly, the read-out line SIO and the data lines DL_R, DL_G, and DL_B of the non-sensing pixels have the same potential, and thus the line capacitance of the read-out line SIO is reduced compared to the comparative example. Therefore, as compared to the comparative example (Before), a time taken to charge the saturation voltage of the source node in the read-out line SIO can be reduced, and as a result, the sensing period ② can be decreased in the embodiment (After).

In the sampling period ③, the sampling switch SAM is turned on by the on-level signal to connect the read-out line (SIO) and the ADC. Accordingly, the source voltage value of the driving TFT DT stored in the read-out line SIO can be sampled. Thereafter, the threshold voltage Vth of the driving TFT DT may be obtained by calculating a difference (4.5 V−Sen=Φ) between a W data value Vdata_W applied to the sensing pixel and a sensed voltage Sen. In the embodiment (After), the sensing period ② can be reduced compared to the comparative example (Before), and thus sampling can be performed more rapidly in the embodiment (After) than in the comparative example (Before). Therefore, the entire sensing time can be reduced.

As described above, in the sensing method according to the embodiment, a data voltage for sensing is applied to the data line DL of the sensing pixel, and a voltage having the same potential as the voltage of the read-out line SIO is fed back to the data lines DL of the non-sensing pixels. Accordingly, capacitance generated due to the potential difference between the read-out line SIO and the data lines DL of the non-sensing pixels can be removed, and as a result, the capacitance of the read-out line SIO is reduced to shorten the sensing time.

Figure 8:
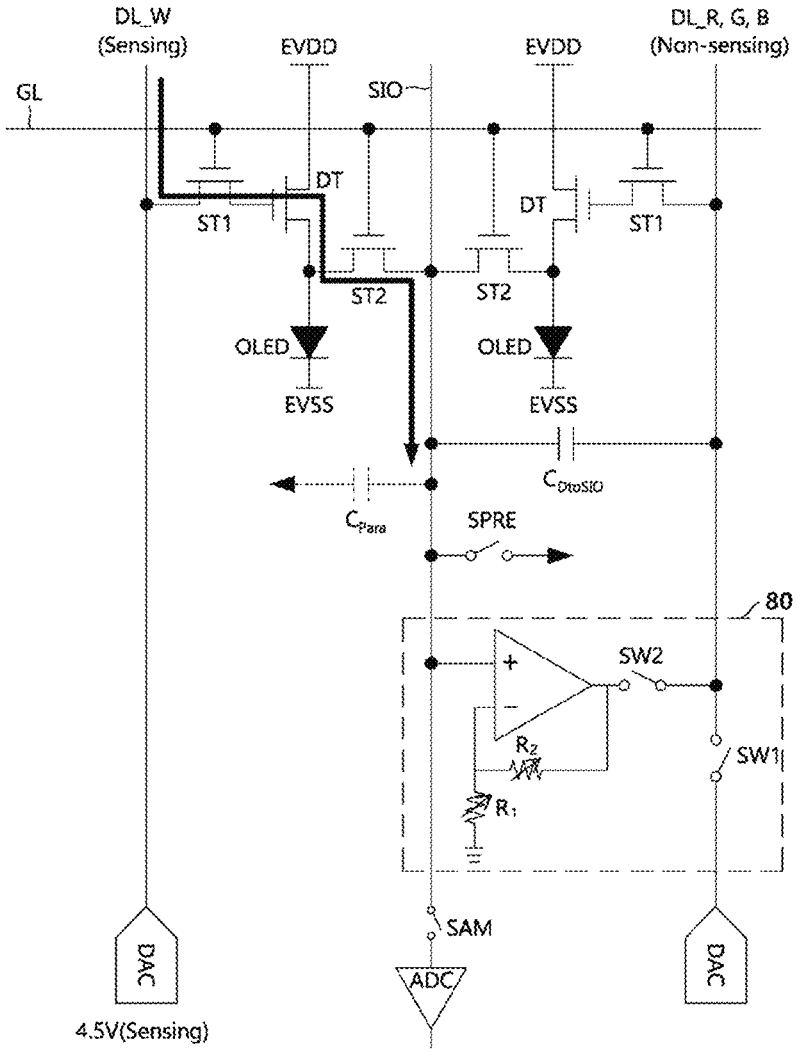
FIG. 8 is a diagram illustrating an equivalent circuit during a sensing operation of an electroluminescent display device according to a first embodiment of the present disclosure.

FIG. 8 is a diagram showing an equivalent circuit during a sensing operation of the electroluminescent display device according to the first embodiment shown in FIG. 6 and illustrates a case in which the W sub-pixel among R, W, G, and B sub-pixels sharing the readout line SIO is sensed. Referring to FIG. 8, a sensing voltage supplied through the DAC of the data driver 12 is applied to the W data line DL_W to which the W subpixel, which is a sensing pixel, is connected. The driving TFT DT of the sensing pixel W to which the sensing voltage has been supplied performs a source-following operation and thus the voltage of the source node increases. Accordingly, the voltage of the source node of the sensing pixel W is charged in the line capacitor Cpara of the read-out line SIO connected to the source node. Thereafter, when the sampling switch SAM is turned on, the read-out line SIO and the ADC can be connected to sample the source voltage value of the driving TFT DT stored in the read-out line SIO.

The data lines DL_R, DL_W, DL_G, and DL_B to which the non-sensing pixels R, G, and B are connected are connected to the read-out line SIO through the feedback unit 80. A voltage supplied through the feedback unit 80 is applied to the data lines DL_R, DL_G, and DL_B to which the non-sensing pixels R, G, and B are connected. The voltage supplied through the feedback unit 80 has the same value as the voltage of the read-out line SIO. Accordingly, capacitance $C_{DtoSIO}$ between the data lines DL_R, DL_W, DL_G, and DL_B of the non-sensing pixels R, G, and B and the read-out line SIO can be removed.

Here, the feedback unit 80 includes an amplifier Amp that receives and outputs a sensing voltage of the read-out line SIO, and feedback switches SW1 and SW2 that connect the output terminal of the amplifier to the data line of a non-sensing pixel.

As the amplifier Amp, a non-inverting amplifier in which the voltage of the read-out line SIO is input to the non-inverting terminal (+) and the output voltage is fed back to the inverting terminal (−) may be applied. In the non-inverting amplifier, the input voltage and the output voltage have the same polarity and the gain can be adjusted according to the ratio of an input resistor R1 and a feedback resistor R2 interposed in a feedback line of the output voltage. The resistors R1 and R2 that determine the gain may be designed as variable resistors as shown in FIG. 8, or may be implemented as fixed resistors.

The first feedback switch SW1 controls connection between the data line DL and the DAC of the data driver 12, and the second feedback switch SW2 controls connection between the data line DL and the feedback unit 80.

When a sensing voltage is applied during the sensing operation or an image data voltage is applied during the display operation, the first feedback switch SW1 is turned on such that the data line DL is connected to the data driver 12.

When the non-sensing pixels are selected during the sensing operation, the second feedback switch SW2 is turned on such that the data line DL is connected to the output line of the amplifier of the feedback unit 80. The feedback unit 80 applies the same voltage as the voltage of the read-out line SIO to the data line DL. Accordingly, the capacitance $C_{DtoSIO}$ between the data lines DL_R, DL_G, and DL_B of the non-sensing pixels R, G, and B and the read-out line SIO is removed and thus a time required for the source voltage of the sensing pixel to be charged in the read-out line SIO can be reduced, thereby shortening sensing time.

Figure 9:
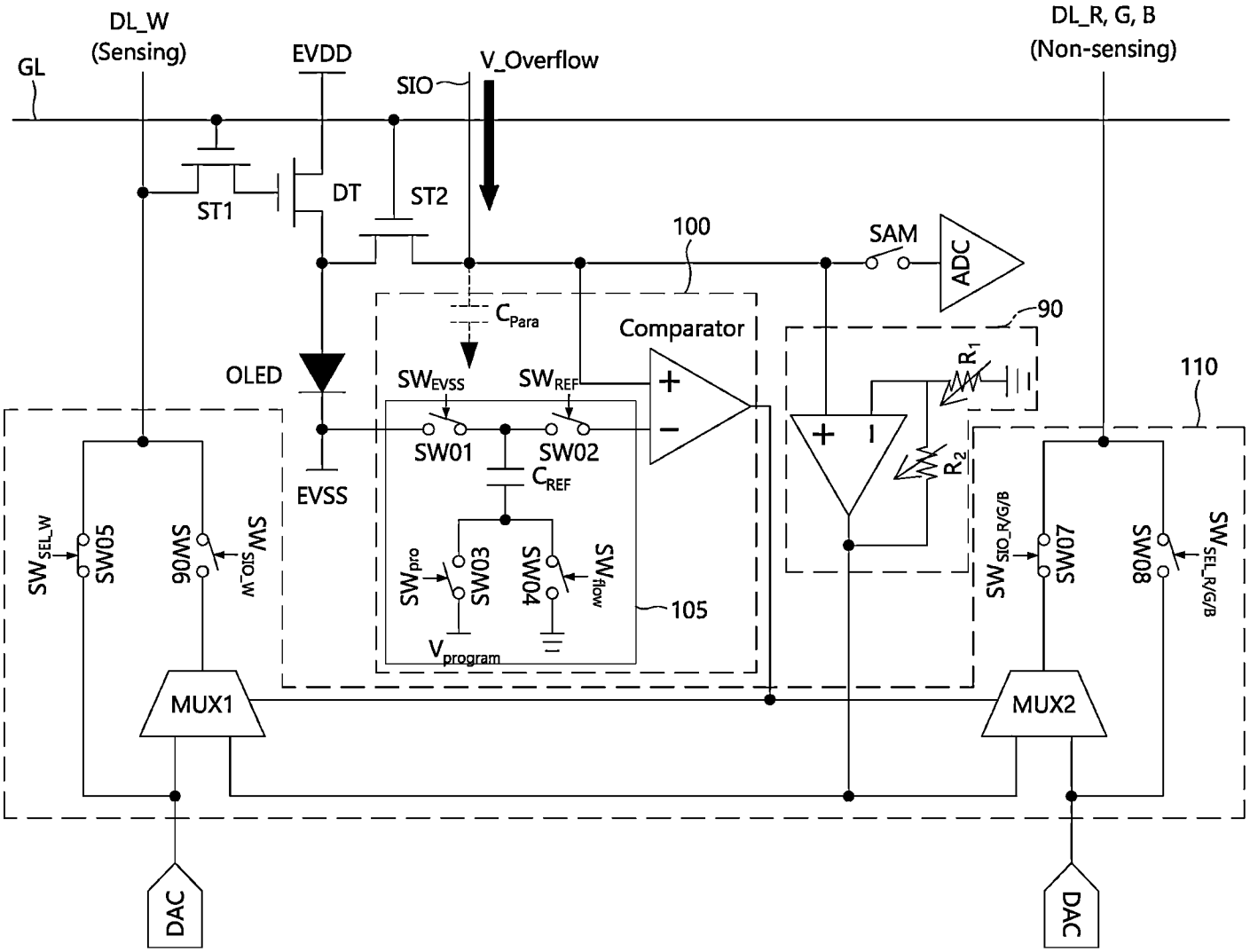
FIG. 9 is a diagram illustrating a circuit of an electroluminescent display device according to a second embodiment of the present disclosure.

FIG. 9 is a diagram illustrating a circuit of an electroluminescent display device according to a second embodiment of the present disclosure.

When a failure such as an OLED short-circuit occurs, an overflow voltage that is out of the output range of the ADC due to leakage of pixel current may be applied to the read-out line SIO. In case of a failure causing overflow, a very high voltage V Overflow is applied to the read-out line SIO. Accordingly, when the feedback unit 90 applies the same voltage as the voltage of the read-out line SIO to the data lines DL_R, DL_G, and DL_B of the non-sensing pixels, a malfunction in which the non-sensing pixels are turned on may occur. The second embodiment of the present disclosure may further include a configuration for preventing such malfunction.

The electroluminescent display device according to the second embodiment of the present disclosure includes a feedback unit 90 that outputs a feedback voltage corresponding to the voltage of the read-out line SIO, a defective pixel determination unit 100 that determines whether a sensing pixel is defective, and a selector 110 that selects a voltage input to each of the data lines DL_R, DL_W, DL_G, and DL_B according to the result of determination of the defective pixel determination unit 100 in a pixel structure in which four sub-pixels share one read-out line SIO.

FIG. 9 shows a circuit connection relationship among the data line DL_W of the sensing pixel, the data lines DL_R, DL_G, and DL_B of the non-sensing pixels, the read-out line SIO, the feedback unit 90, the defective pixel determination unit 100, and the selector 110.

The feedback unit 90 receives the sensing voltage of the read-out line SIO and outputs a voltage having the same potential as the voltage of the read-out line SIO. The feedback unit 90 may include an amplifier Amp that receives the sensing voltage of the read-out line SIO, applies a preset gain thereto, and outputs the sensing voltage to which the gain has been applied. As the amplifier Amp, a non-inverting amplifier in which the voltage of the read-out line SIO is input to the non-inverting terminal (+) and the output voltage is fed back to the inverting terminal (−) may be applied. In the non-inverting amplifier, the input voltage and the output voltage have the same polarity and the gain can be adjusted according to the ratio of an input resistor R1 and a feedback resistor R2 interposed in a feedback line of the output voltage.

The defective pixel determination unit 100 compares the voltage of the read-out line SIO with a preset overflow voltage and outputs a comparison result to the selector 110. The defective pixel determination unit 100 may include a comparator and a setting circuit 105 for setting a reference voltage at a non-inverting terminal (−) of the comparator.

The comparator compares a voltage input to the inverting terminal (−) thereof with a voltage input to the non-inverting terminal (+) thereof, outputs a logic value of "0" if the voltage input to the non-inverting terminal (+) is lower, and outputs a logic value of "1" if the voltage input to the non-inverting terminal (+) is higher. The read-out line SIO is connected to the non-inverting terminal (+) of the comparator. The setting circuit 105 for setting the reference voltage for determining a defective pixel is connected to the inverting terminal (−). The comparator outputs a logical value of "0" if the voltage of the read-out line SIO input to the non-inverting terminal (+) is lower and outputs a logic value of "1" if the voltage is higher. When the voltage of the read-out line SIO is higher, the corresponding pixel may be determined to be a defective pixel. Accordingly, the output of the comparator may be logical "1" in the case of a defective pixel and logical "0" in the case of a normal pixel.

The setting circuit 105 applies the reference voltage for determining a defective pixel to the inverting terminal (−) of the comparator. The setting circuit 105 may include first to fourth switches SW01, SW02, SW03, and SW04 and a reference voltage capacitor $C_{REF}$ in which the reference voltage of the comparator is stored. The setting circuit 105 may store the reference voltage input to the inverting terminal (−) of the comparator in the reference voltage capacitor $C_{REF}$ using the voltage EVSS of the sub-pixel and a preset program voltage $V_{program}$. A specific method for storing the reference voltage in the setting circuit 105 will be described later in detail.

The defective pixel determination unit 100 including the above-described components compares the voltage of the read-out line SIO with the preset overflow voltage and outputs a comparison result to the selector 110. The defective pixel determination unit 100 may output a logic value of "1" in the case of a defective pixel and output a logical value of "0" in the case of a normal pixel through the comparator.

The selector 110 selects a voltage applied to each of the data lines DL_R, DL_W, DL_G, and DL_B according to the determination result of the defective pixel determination unit 100. The selector 110 may include a multiplexer MUX that is provided on each data line DL and selectively applies the output of the DAC or the output of the feedback unit 90 according to the determination result of the defective pixel determination unit 100, a switch that selectively connects the output line of the MUX and the data line DL, and a switch that selectively connects the DAC and the data line DL.

Referring to FIG. 9, the selector 110 includes a first multiplexer MUX1 interposed between the data line DL_W of the sensing pixel and the DAC, a second multiplexer MUX2 interposed between the data line DL_R, DL_G, and DL_B of the non-sensing pixels and the DAC, and fifth to eighth switches SW05, SW06, SW07, and SW08 for controlling connection of each data line.

In the selector 110, the data line DL_W of the sensing pixel is branched into two lines, one of which is connected to the DAC of the data driver 12 through the fifth switch SW05 and the other line is connected to the first multiplexer MUX1 through the sixth switch SW06.

The fifth switch SW05 is turned on by a W selection signal $SW_{SEL_W}$ to connect the data line DL_W of the sensing pixel to the DAC.

The sixth switch SW06 is turned on by a read-out line selection signal $SW_{SIO_W}$ to connect the first multiplexer MUX1 to the data line DL_W.

The first multiplexer MUX1 outputs the voltage of the output line of the DAC of the data driver 12 or the voltage of the read-out line SIO. The first multiplexer MUX1 outputs the output voltage of the DAC when a logic value of "1", which indicates a defective pixel, is input from the defective pixel determination unit 100 and outputs the voltage of the feedback unit 90 when a logical value of "0", which indicates a normal pixel, is input.

In the selector 110, each of the data lines DL_R, DL_G, and DL_B of the non-sensing pixels is branched into two lines, one of which is connected to the DAC of the data driver 12 through the eighth switch SW08 and the other line is connected to the second multiplexer MUX2 through the seventh switch SW07.

The eighth switch SW08 is turned on by R, G, and B selection signals $SW_{SEL_R/G/B}$ to connect the data lines DL_R, DL_G, and DL_B of the non-sensing pixels to the DAC.

The seventh switch SW07 is turned on by read-out line selection signals $SW_{SIO_R/G/B}$ to connect the second multiplexer MUX2 to the data lines DL_R, DL_G, and DL_B of the non-sensing pixels.

The second multiplexer MUX2 outputs the voltage of the output line of the DAC of the data driver 12 or the voltage of the read-out line SIO. The second multiplexer MUX2 outputs the output voltage of the DAC when a logic value of "1", which indicates a defective pixel, is input from the defective pixel determination unit 100 and outputs the voltage of the feedback unit 90 when a logical value of "0", which indicates a normal pixel, is input.

With this configuration, the defective pixel determination unit 100 determines whether the voltage of the read-out line SIO is equal to or greater than the reference voltage and outputs the determination result in the electroluminescent display device according to the second embodiment of the present disclosure. The determination result output from the defective pixel determination unit 100 is input to the selector 110. If the voltage of the read-out line SIO is lower than the reference voltage, the selector 110 applies the output voltage of the feedback unit 90 to the data lines DL_R, DL_G, and DL_B of the non-sensing pixels. If the voltage of the read-out line SIO is higher than the reference voltage, the selector 110 connects the output line of the DAC to the data lines DL_R, DL_G, and DL_B of the non-sensing pixels. Accordingly, it is possible to prevent the voltage of the read-out line SIO from being applied to the data lines DL_R, DL_G, and DL_B of the non-sensing pixels when an overflow voltage is applied to the read-out line SIO due to a defective sub-pixel.

Figure 10:
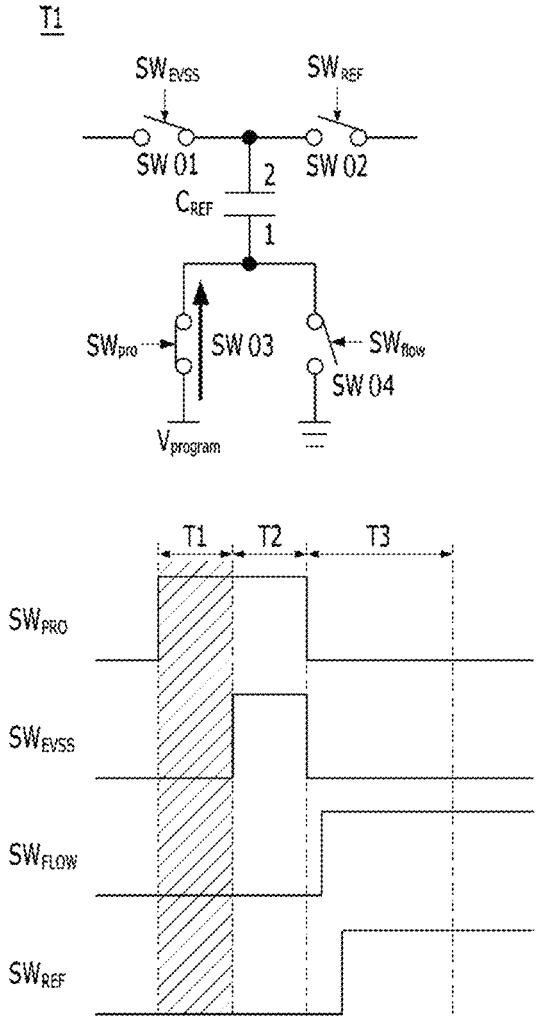
FIGS. 10 to 12 are diagrams for describing a reference voltage setting method of a setting circuit of FIG. 9.
Figure 11:
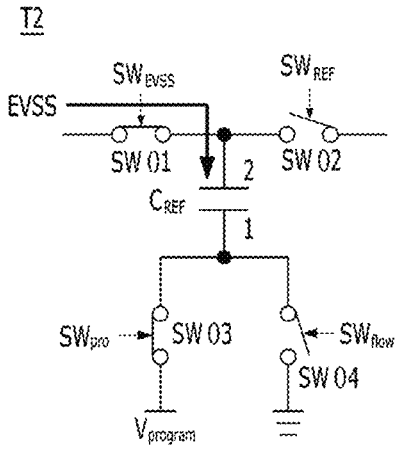
Figure 11:
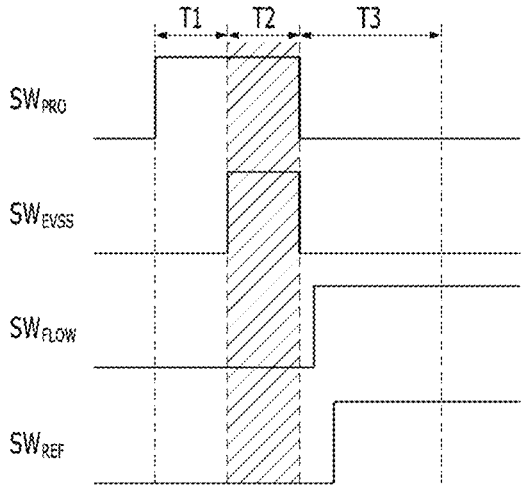
Figure 12:
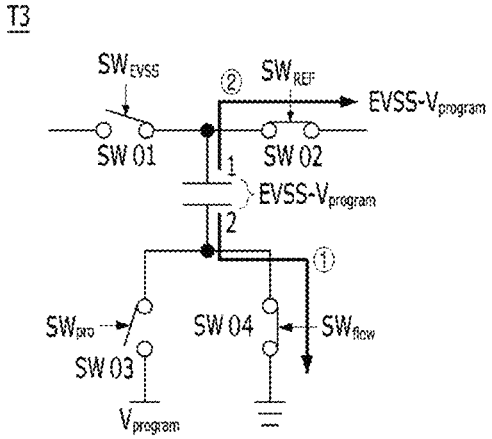
Figure 12:
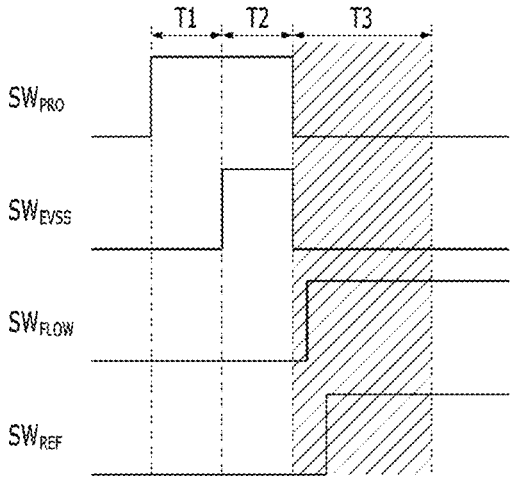

FIGS. 10 to 12 are diagrams for describing the operation of the setting circuit 105 of FIG. 9.

The setting circuit 105 includes the first to fourth switches SW01, SW02, SW03, and SW04 and the reference voltage capacitor $C_{REF}$ in which the reference voltage of the comparator is stored.

The first switch SW01 is turned on by an EVSS selection signal $SW_{EVSS}$ such that a second electrode of the reference voltage capacitor $C_{REF}$ is connected to the voltage EVSS of the subpixel.

The second switch SW02 is turned on by a reference voltage selection signal $SW_{REF}$ such that the second electrode of the reference voltage capacitor $C_{REF}$ is connected to the inverting terminal (−) of the comparator.

The third switch SW03 is turned on by a program selection signal $SW_{pro}$ such that a first electrode of the reference voltage capacitor $C_{REF}$ is connected to the preset program voltage $V_{program}$.

The fourth switch SW04 is turned on by a flow selection signal $SW_{flow}$ such that charges stored in the first electrode of the reference voltage capacitor $C_{REF}$ flow.

The operation of storing the reference voltage of the comparator in the setting circuit 105 having the aforementioned configuration may include first to third periods T1 to T3.

Referring to FIG. 10, the third switch SW03 is turned on by the program selection signal $SW_{pro}$ in the first period T1. Accordingly, the program voltage $V_{program}$ is applied to the first electrode of the reference voltage capacitor $C_{REF}$ through the third switch SW03.

Referring to FIG. 11, the first switch SW01 is turned on by the EVSS selection signal $SW_{EVSS}$ in a state in which the third switch SW03 is turned on such that the voltage EVSS is applied to the second electrode of the reference voltage capacitor $C_{REF}$ in the second period T2. Accordingly, the voltage EVSS is applied to the first electrode of the reference voltage capacitor $C_{REF}$ and the program voltage $V_{program}$ is applied to the second electrode of the reference voltage capacitor $C_{REF}$.

Referring to FIG. 12, the fourth switch SW04 is first turned on by the flow selection signal $SW_{flow}$ such that the voltage of the first electrode of the reference voltage capacitor $C_{REF}$ is dropped by the program voltage $V_{program}$ in the third period T3 (①). Accordingly, a voltage "EVSS-$V_{program}$" is charged in the reference voltage capacitor $C_{REF}$. Thereafter, the second switch SW02 is turned on by the reference voltage selection signal $SW_{REF}$ such that the second electrode of the reference voltage capacitor $C_{REF}$ is connected to the inverting terminal (−) of the comparator. Accordingly, the reference voltage of the comparator is set to the voltage "EVSS-$V_{program}$" Thereafter, the comparator may compare the voltage "EVSS-$V_{program}$" with the voltage of the read-out line SIO and output a comparison result.

Figure 13:
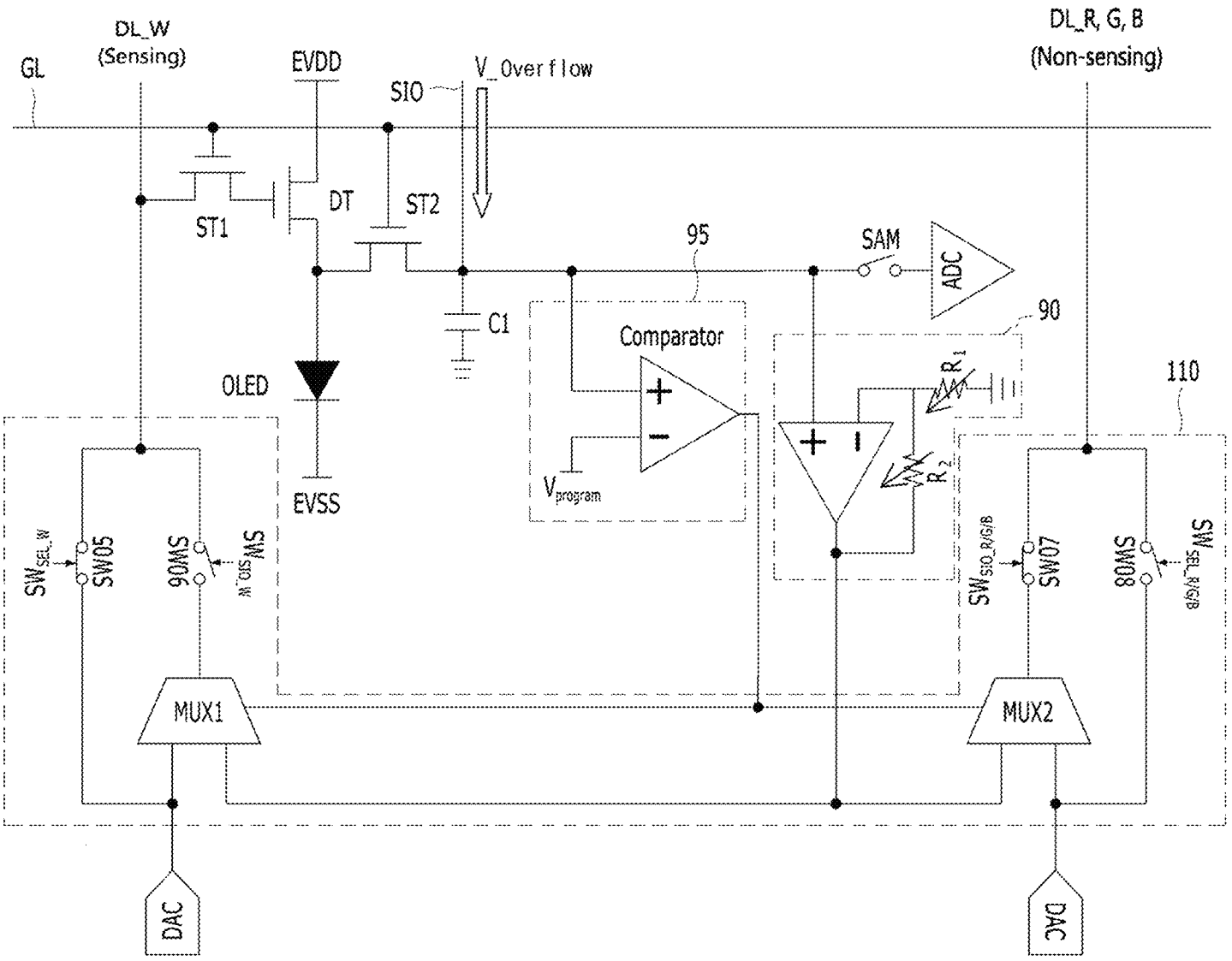
FIG. 13 is a diagram illustrating a circuit of an electroluminescent display device according to a third embodiment of the present disclosure.

FIG. 13 is a diagram illustrating a circuit of an electroluminescent display device according to a third embodiment of the present disclosure. The third embodiment is configured by simplifying the configuration of the defective pixel determination unit 100 in the second embodiment of FIG. 9. Accordingly, the same components as those of FIG. 9 are denoted by the same reference numerals and redundant description of the same components will be omitted.

Referring to FIG. 13, the electroluminescent display device according to the third embodiment of the present disclosure includes the feedback unit 90 that outputs a feedback voltage corresponding to the voltage of the read-out line SIO, a defective pixel determination unit 95 that determines whether the sensing pixel is defective, and the selector 110 that selects a voltage input to each of the data lines DL_R, DL_W, DL_G, and DL_B according to a defective pixel determination result.

The defective pixel determination unit 95 compares the voltage of the read-out line SIO with a preset overflow voltage and outputs the comparison result to the selector 110. The defective pixel determination unit 95 may include a comparator.

The read-out line SIO is connected to the non-inverting terminal (+) of the comparator. A preset program voltage $V_{program}$ is input to the inverting terminal (−) as a reference voltage. The program voltage $V_{program}$ may be set to a voltage that is a criterion for determining a defective pixel, for example, a voltage close to the overflow voltage.

The comparator outputs a logic value of "1" if the voltage of the read-out line SIO input to the non-inverting terminal (+) is higher than the program voltage $V_{program}$ input to the inverting terminal (−) and outputs a logic value of "0" if it is lower than the program voltage $V_{program}$.

Accordingly, when overflow occurs due to a failure such as OLED short-circuit, the defective pixel determination unit 95 may output a logic value of "1".

With this configuration, the defective pixel determination unit 95 determines whether the voltage of the read-out line SIO is equal to or greater than the preset program voltage $V_{program}$ and outputs the determination result in the electroluminescent display device according to the third embodiment of the present disclosure. The determination result output from the defective pixel determination unit 95 is input to the selector 110. When the voltage of the read-out line SIO is lower than the reference voltage, the selector 110 applies the output voltage of the feedback unit 90 to the data lines DL_R, DL_G, and DL_B of the non-sensing pixels. When the voltage of the read-out line SIO is higher than the reference voltage, the selector 110 connects the output line of the DAC to the data lines DL_R, DL_G, and DL_B of the non-sensing pixels. Accordingly, when an overflow voltage is applied to the read-out line SIO due to a defective sub-pixel, it is possible to prevent the voltage of the read-out line SIO from being applied to the data lines DL_R, DL_G, and DL_B of the non-sensing pixels.

Figure 14:
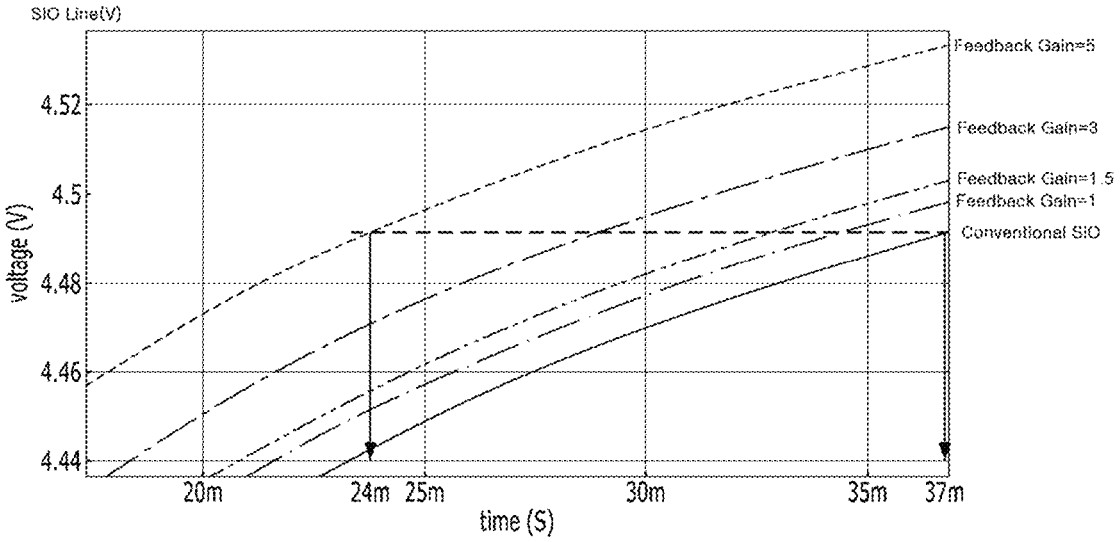
FIG. 14 is a graph showing simulation results of an electroluminescent display device according to an embodiment of the present disclosure.

FIG. 14 is a graph showing simulation results of an electroluminescent display device according to an embodiment of the present disclosure.

FIG. 14 is a graph showing a simulation of a potential change in the read-out line SIO according to a gain of the feedback unit 90. In the graph, the horizontal axis represents time and the vertical axis represents the voltage of the read-out line SIO.

During the sensing operation, the driving TFT is driven in a source following manner and thus the potential of the source node gradually increases and then enters a saturation state. This potential change in the source node is sensed through the read-out line SIO.

The graph of FIG. 14 shows results of simulations of voltage changes (SIO Line V) in the lead-out line according to lapse of time when the conventional read-out line sensing method (conventional) is employed, when a voltage obtained by applying Gain=1 to a sensing voltage of the read-out line SIO is applied to data lines of non-sensing pixels, when a voltage obtained by applying Gain=1.5 to the sensing voltage is applied to the data lines of the non-sensing pixels, when a voltage obtained by applying Gain=3 to the sensing voltage is applied to the data lines of the non-sensing pixels, and when a voltage obtained by applying Gain=5 to the sensing voltage is applied to the data lines of the non-sensing pixels.

Comparing the voltages (SIO Line V) of the read-out line at the same point in time, 24 ms, it can be ascertained that a highest voltage is measured when Gain=5 is applied and the voltage (SIO Line V) of the read-out line also gradually decreases as the gain decreases. When the conventional read-out line sensing method (conventional) is employed, the voltage (SIO Line V) of the read-out line is the lowest. Accordingly, it can be ascertained that charging time of the read-out line SIO decreases as the voltage of the read-out line SIO is fed back to the data lines of the non-sensing pixels by applying a high gain.

Comparing timings at which the same voltage is measured, it can be ascertained that the corresponding voltage is reached in a shortest time (24 ms) when Gain=5 is applied, and the time taken to reach the same voltage gradually increases as the gain decreases.

According to the above-described simulation results, sensing time can be reduced when a predetermined gain is applied to the voltage (SIO Line V) of the read-out line and the voltage is applied to the data lines of the non-sensing pixels, and the sensing time can decrease as the gain value increases.

It will be apparent to those skilled in the art that various modifications and variations can be made in the electroluminescent display device and the method for sensing electrical characteristics thereof of the present disclosure without departing from the technical idea or scope of the disclosure. Thus, it is intended that the present disclosure cover the modifications and variations of this disclosure provided they come within the scope of the appended claims and their equivalents.

What is claimed is:

1. An electroluminescent display device, comprising:

a display panel including a plurality of pixels including a sensing pixel and a non-sensing pixel connected to a respective data line of a plurality of data lines, the plurality of pixels sharing one sensing line;

a sensing circuit configured to sense an electrical characteristic value of the sensing pixel based on a sensing voltage applied to the shared sensing line; and a feedback unit configured to apply a feedback voltage according to the sensing voltage applied to the shared sensing line to the data line of the non-sensing pixel, wherein the feedback unit includes:

an amplifier configured to receive the sensing voltage, to apply a preset gain to the sensing voltage, and to output the sensing voltage to which the preset gain is applied; and a feedback switch configured to connect an output line of the amplifier to the data line of the non-sensing pixel.

2. The electroluminescent display device according to claim 1, wherein the feedback voltage has a voltage value that minimizes a potential difference between the shared sensing line and the data line of the non-sensing pixel.

3. The electroluminescent display device according to claim 1, further comprising a data driver configured to supply a data voltage for sensing to the data line of the sensing pixel.

4. The electroluminescent display device according to claim 1, wherein the amplifier includes:

a non-inverting amplifier including a non-inverting input terminal to which the shared sensing line is connected, and an inverting input terminal to which a feedback line of an output terminal of the non-inverting amplifier is connected, the output terminal being connected to the data line of the non-sensing pixel;

a first resistor connected to the inverting input terminal; and a second resistor connected to the feedback line.

5. The electroluminescent display device according to claim 4, wherein the first resistor and the second resistor include variable resistors.

6. The electroluminescent display device according to claim 1, further comprising a defective pixel determination unit configured to compare the sensing voltage with a preset reference voltage and to control the feedback voltage not to be applied to the data line of the non-sensing pixel if the sensing voltage is equal to or greater than the reference voltage, wherein the defective pixel determination unit includes a non-inverting input terminal to which the shared sensing line is connected, an inverting input terminal to which the reference voltage is input, and a comparator configured to output a result of comparison between the sensing voltage and the reference voltage.

7. The electroluminescent display device according to claim 6, further comprising:

a data driver configured to supply a data voltage for sensing to the data line of the sensing pixel; and a selector configured to apply the feedback voltage or the data voltage output from the data driver to the respective data line according to a determination result of the defective pixel determination unit.

8. The electroluminescent display device according to claim 7, wherein the selector includes a multiplexer configured to output the feedback voltage to the data line of the non-sensing pixel if the sensing voltage is less than the reference voltage and to apply the data voltage output from the data driver to the data line of the sensing pixel if the sensing voltage is equal to or greater than the reference voltage.

9. The electroluminescent display device according to claim 1, wherein the electrical characteristic value of the sensing pixel includes a threshold voltage value of a driving Thin-Film Transistor of the sensing pixel.

10. The electroluminescent display device according to claim 1, further comprising a compensator configured to determine a data compensation amount for each of the plurality of pixels based on a sensed data received from the sensing circuit and obtained by converting the sensed voltage.

11. A method for sensing electrical characteristics of an electroluminescent display device including a display panel having a plurality of pixels including a sensing pixel and a non-sensing pixel connected to a respective data line of a plurality of data lines, the plurality of pixels sharing one sensing line, the method comprising:

supplying a data voltage for sensing to the data line of the sensing pixel;

applying a feedback voltage to the data line of the non-sensing pixel according to a sensing voltage applied to the shared sensing line; and sensing an electrical characteristic value of the sensing pixel based on the sensing voltage, wherein the method further comprises comparing the sensing voltage with a preset reference voltage, and wherein the applying of the feedback voltage to the data line of the non-sensing pixel according to the sensing voltage applied to the shared sensing line comprises applying the feedback voltage to the data line of the non-sensing pixel if the sensing voltage is less than the reference voltage.

12. The method according to claim 11, wherein the feedback voltage has a voltage value that minimizes a potential difference between the shared sensing line and the data line of the non-sensing pixel.

13. The method according to claim 11, further wherein the supplying of the data voltage comprises applying the data voltage output from a data driver to the data line of the sensing pixel if the sensing voltage is equal to or greater than the reference voltage.

14. An electroluminescent display device, comprising:

a display panel including a plurality of pixels including a sensing pixel and a non-sensing pixel connected to a respective data line of a plurality of data lines, the plurality of pixels sharing one sensing line;

a sensing circuit configured to sense an electrical characteristic value of the sensing pixel based on a sensing voltage applied to the shared sensing line;

a feedback unit configured to receive the sensing voltage and to apply a feedback voltage according to the sensing voltage to the shared sensing line;

a defective pixel determination unit configured to output a result of comparison between the sensing voltage and a preset reference voltage; and a selector configured to control the feedback voltage to be applied to the data line of the non-sensing pixel if the sensing voltage is less than the reference voltage and to control the feedback voltage not to be applied to the data line of the non-sensing pixel if the sensing voltage is equal to or greater than the reference voltage.

15. The electroluminescent display device according to claim 14, further comprising:

a data driver configured to supply a data voltage for sensing to the data line of the sensing pixel, wherein the selector is configured to apply the data voltage output from the data driver to the data line of the non-sensing pixel if the sensing voltage is equal to or greater than the reference voltage.

* * * * *